US005128197A

United States Patent [19]

Kobayashi et al.

[11] Patent Number: 5,128,197

[45] Date of Patent: Jul. 7, 1992

[54] WOVEN FABRIC MADE OF SHAPE MEMORY POLYMER

[75] Inventors: Kazuyuki Kobayashi; Shunichi Hayashi, both of Nagoya, Japan

[73] Assignee: Mitsubishi Jukogyo Kabushiki Kaisha, Tokyo, Japan

[21] Appl. No.: 420,574

[22] Filed: Oct. 12, 1989

[30] Foreign Application Priority Data

Oct. 17, 1988 [JP] Japan ..... 63-259525

[51] Int. Cl.[5] ..... D03D 3/00

[52] U.S. Cl. ..... 428/225; 2/129; 57/252; 428/229; 428/230; 428/231; 428/257; 428/258; 428/259; 428/910

[58] Field of Search ..... 428/229, 230, 231, 257, 428/258, 259, 225, 910; 57/252; 2/129

[56] References Cited

U.S. PATENT DOCUMENTS

| | | | |
|---|---|---|---|
| 2,384,936 | 9/1945 | Lilley et al. | 428/231 |
| 3,199,548 | 8/1965 | Conant | 428/231 |
| 3,616,149 | 5/1968 | Wincklhofer et al. | 161/89 |
| 3,618,141 | 11/1971 | Collingwood et al. | 2/236 |
| 3,620,892 | 5/1972 | Wincklhofer et al. | 161/89 |
| 3,741,170 | 6/1973 | Hinckley | 74/9 |
| 4,424,808 | 1/1984 | Schäfer et al. | 428/231 |
| 4,563,384 | 1/1986 | Wehe et al. | 428/231 |
| 4,728,565 | 3/1988 | Fontana | 428/231 |
| 4,734,320 | 3/1988 | Ohira et al. | 428/231 |
| 4,737,400 | 4/1988 | Edison et al. | 428/231 |

FOREIGN PATENT DOCUMENTS

| | | |
|---|---|---|
| 225346 | 7/1981 | Japan . |
| 61-225346 | 7/1986 | Japan . |
| 252353 | 11/1986 | Japan . |
| 293214 | 12/1986 | Japan . |

OTHER PUBLICATIONS

"Development of Polymeric Elasticity Memory Material", Mitsubishi Juko GIHO vol. 25, No. 3 (1988) pp. 236–240.

*Primary Examiner*—James J. Bell
*Attorney, Agent, or Firm*—McAulay Fisher Nissen Goldberg & Kiel

[57] ABSTRACT

A woven fabric woven from fibers of a shape memory polymer alone or a blend of said fibers and ordinary natural or synthetic fibers.

10 Claims, No Drawings

WOVEN FABRIC MADE OF SHAPE MEMORY POLYMER

FIELD OF THE INVENTION AND RELATED ART STATEMENT

The present invention relates to a woven fabric woven from fibers of a shape memory polymer alone or a blend of said fibers and ordinary natural or synthetic fibers.

The conventional woven fabric is made of natural or synthetic fibers or a blend of both. These fibers are also used in combination with an adhesive to produce nonwoven fabrics. There has recently been proposed a nonwoven fabric which is composed of fibers of a resin having the shape memory property and an adhesive of a resin having the shape memory property. (See Japanese Patent Laid-open No. 252353/1986.)

Being made by bonding short fibers to one another with an adhesive, a nonwoven fabric has the following disadvantages.

(1) It tends to be thick.

(2) It tends to be uneven in thickness and hence in strength because it is difficult to distribute the adhesive uniformly.

(3) It is high in cost owing to the expensive adhesive.

The foregoing holds true of the nonwoven fabric made of shape memory resin mentioned above.

Another disadvantage of the conventional nonwoven fabric made of shape memory resins is a high production cost attributable to additional processes. For example, where short fibers of a shape memory resin are used in combination with natural or synthetic long fibers, it is necessary to cut the latter short according to the length of the former. Also, there is an instance where a woven fabric of natural or synthetic fibers has to be laminated with an adhesive to a nonwoven fabric composed of fibers of a shape memory resin and an adhesive of a shape memory resin. The adhesive for lamination also adds to the production cost.

OBJECT AND SUMMARY OF THE INVENTION

The present invention was completed to solve the above-mentioned problem associated with the conventional nonwoven fabric made of a shape memory resin. Accordingly, it is an object of the present invention to provide a woven fabric having the shape memory property.

The gist of the present invention resides in a woven fabric of shape memory polymer which is formed by weaving yarns of shape memory polymer fibers alone or by weaving said yarns and yarns of ordinary natural or synthetic fibers, and also in a woven fabric of shape memory polymer which is formed by weaving blended yarns of shape memory polymer fibers and ordinary natural or synthetic fibers.

The woven fabric of the present invention functions differently as follows depending on the glass transition point (Tg for short hereinafter) of the shape memory polymer in the woven fabric and the method of imparting the shape memory property.

In the case where the Tg is lower than normal temperature (say, about −5° C.) and the shape memory property is imparted at a temperature considerably higher than the Tg (say, a temperature at which the polymer begins to flow, or 150° C. in the case of polyurethane), the woven fabric cut to an adequate size is caused to remember its shape when it is deformed as desired in a mold, and heated and held in the mold at a temperature at which the polymer begins to flow, and finally cooled to normal temperature in the deformed state.

The woven fabric remembering the desired shape gives soft hand like an ordinary cloth when it is used at normal temperature, which is higher than the Tg. It does not wrinkle and deform even when it is washed or stored for a long time in a wardrobe.

Therefore, the woven fabric having a low Tg can be favorably applied to the creases of slacks and the pleats of skirts if it is caused to remember the shape at a high temperature.

In the case where the Tg is higher than normal temperature (say, about 40° C.) and the shape memory property is imparted at a temperature (say, 150° C.) at which the polymer begins to flow, the woven fabric gives hard hand at normal temperature. Even if it wrinkles or deforms after washing or storage for a long time in a wardrobe, it easily returns to its original shape it remembers when it is heated above the Tg.

Therefore, the woven fabric having a high Tg can be favorably applied to the collars, cuffs, and shoulder pads of utility shirts.

In the case where the Tg is higher than normal temperature (say, about 40° C.) as mentioned above and the shape memory property is imparted in the softened state at a temperature (say, 90° C.) slightly higher than the Tg (instead of the above-mentioned high temperature at which the polymer begins to flow) and then the woven fabric is cooled below the Tg, the woven fabric is set in the deformed shape which has been given when softened and remembers this shape.

In this case, the woven fabric gives hard hand when used at normal temperature, which is lower than the Tg, as with the above-mentioned case. Even if it wrinkles or deforms after washing or storage for a long time in a wardrobe, it easily returns to its original shape it remembers when it is heated above the Tg.

Therefore, in this case, too, the woven fabric can be favorably applied to the collars, cuffs, and shoulder pads of utility shirts.

Incidentally, in the case where the Tg is lower than normal temperature (say, about −5° C.) and the shape memory property is imparted in the softened state at a temperature slightly higher than the Tg as mentioned above, the woven fabric cannot be used in the shape it remembers because the normal use temperature is higher than the Tg. This is not the case, however, if the woven fabric is used at low temperatures below −5° C. In other words, the woven fabric can be used in the shape it remembers only in special districts under special conditions.

The above-mentioned shape memory function can be freely controlled by many factors in the following manner.

(1) In the case where the woven fabric is composed of yarns of shape memory polymer alone, the ability of the woven fabric to retain the shape depends on the fineness of the yarn and the set of the cloth.

(2) In the case where the woven fabric is composed of yarns of the shape memory polymer fibers and yarns of ordinary natural or synthetic fibers, whether the woven fabric has hand similar to or different from that of the woven fabric of natural or synthetic fibers depends on the blending ratio and fineness of the polymer yarns.

(3) In the case where the woven fabric is composed of blended yarns of shape memory polymer fibers and ordinary natural or synthetic fibers, the ability to retain the shape and the hand of the woven fabric depends on the amount, the fineness and cross-section of the blended yarns, and the set of the woven cloth.

In the case where the woven fabric is composed of blended yarns, the woven fabric exhibits the shape memory function easier or harder as the amount of the shape memory polymer increases or decreases, respectively. Therefore, the amount of the shape memory polymer should preferably be 10 to 96 wt % in the blended yarns.

As the shape memory polymer that can be used in the present invention may be cited urethane polymers, styrenebutadiene polymers, crystalline diene polymers, and norbornane polymers. Their Tg can be freely controlled by properly selecting the kind of the raw materials (monomers, chain extender, etc.) and their mixing ratio.

The woven fabric of the present invention has an advantage inherent in woven fabrics. That is, the fibers (or yarns) of the shape memory polymer can be easily blended with ordinary natural or synthetic fibers (or yarns thereof). Unlike the conventional nonwoven fabric mentioned above, there is no need for cutting long fibers short, or laminating with an adhesive nonwoven fabrics separately prepared from shape memory polymer fibers and natural or synthetic fibers.

DETAILED DESCRIPTION OF PREFERRED EMBODIMENTS

The present invention will be described in more detail with reference to the following examples which are not intended to restrict the scope of the invention.

[1] Preparation of shape memory polymer

Polyurethane elastomers as the shape memory polymers were prepared by prepolymer process in the following manner according to the formulation shown in Table 1. First, the diisocyanate and polyol were reacted in a specific molar ratio of [NCO]/[OH] to give a prepolymer. When the reaction was complete, the chain extender was added in an amount sufficient to establish a desired molar ratio of [chain extender]/[prepolymer]. After defoaming, the resulting mixture was cured for crosslinking reaction at 80° C. for one or two days in a constant temperature dryer. This process may be carried out with or without solvent.

The polyurethane elastomer produced as mentioned above will have a Tg and other physical properties as desired, if the following six factors are properly selected. (1) the kind of the isocyanate, (2) the kind of the polyol, (3) the kind of the chain extender, (4) the [NCO]/[OH] molar ratio, (5) the [chain extender]/[prepolymer] molar ratio, and (6) the curing condition.

In Table 1, the crystallinity (wt %) was measured by X-ray diffractometry.

TABLE 1

| Raw materials and molar ratio | | M.W. | 1 | 2 | 3 | 4 | 5 | 6 | 7 | 8 | 9 |
|---|---|---|---|---|---|---|---|---|---|---|---|
| Diisocyanate | 2,4-toluene diisocyanate | 174 | 1.5 | | | 1.5 | | | | | |
| | 4,4'-diphenylmethane diisocyanate | 250 | | | | | 1.5 | | | 1.5 | 1.5 |
| | 4,4'-diphenylmethane diisocyanate (carbodiimide-modified) | 290 | | | | | | 1.5 | | | |
| | 4,4'-diphenylmethane diisocyanate (carbodiimide-modified) | 303 | | 1.5 | 1.5 | | | | | | |
| | hexamethylene diisocyanate | 168 | | | | | | | 1.5 | | |
| Polyol | polypropylene glycol | 400 | | | | | | | | | |
| | polypropylene glycol | 700 | | | 1.0 | 1.0 | 1.0 | 1.0 | 1.0 | 1.0 | 1.0 |
| | polypropylene glycol | 1000 | | 0.88 | | | | | | | |
| | 1,4-butaneglycol adipate | 600 | | | | | | | | | |
| | 1,4-butaneglycol adipate | 1000 | | | | | | | | | |
| | 1,4-butaneglycol adipate | 2000 | | | | | | | | | |
| | polytetramethylene glycol | 650 | | | | | | | | | |
| | polytetramethylene glycol | 850 | | | | | | | | | |
| | polytetramethylene glycol | 1000 | | | | | | | | | |
| | polyethylene glycol | 600 | | | | | | | | | |
| | bisphenol-A + propylene oxide | 800 | 1.0 | | | | | | | | |
| Chain extender | ethylene glycol | 62 | | | | | | | | 0.51 | |
| | 1,4-butane glycol | 90 | 0.51 | | | | | | | | 0.51 |
| | bis(2-hydroxyethyl)hydroquinone | 198 | | | | | | | | | |
| | bisphenol-A + ethylene oxide | 327 | | | | | | | | | |
| | bisphenol-A + ethylene oxide | 360 | | 0.51 | 0.51 | 0.51 | 0.51 | 0.51 | 0.51 | | |
| | bisphenol-A + propylene oxide | 360 | | | | | | | | | |
| Measured values of physical properties | Tg (°C.) | | 24 | −10 | 15 | −11 | 14 | 16 | −45 | 9 | 6 |
| | Crystallinity (wt %) | | | 20 | 20 | 30 | | | 25 | | |

| Raw materials and molar ratio | | M.W. | 10 | 11 | 12 | 13 | 14 | 15 | 16 | 17 | 18 |
|---|---|---|---|---|---|---|---|---|---|---|---|
| Diisocyanate | 2,4-toluene diisocyanate | 174 | | | | | | | | | |
| | 4,4'-diphenylmethane diisocyanate | 250 | 1.5 | 1.5 | 1.5 | 1.5 | 1.2 | 1.8 | 1.35 | 1.35 | 1.35 |
| | 4,4'-diphenylmethane diisocyanate (carbodiimide-modified) | 290 | | | | | | | | | |
| | 4,4'-diphenylmethane diisocyanate (carbodiimide-modified) | 303 | | | | | | | | | |
| | hexamethylene diisocyanate | 168 | | | | | | | | | |
| Polyol | polypropylene glycol | 400 | | | | | | | | | |
| | polypropylene glycol | 700 | 1.0 | 1.0 | 1.0 | | 1.0 | 1.0 | 1.0 | | |
| | polypropylene glycol | 1000 | | | | | | | | 1.0 | |
| | 1,4-butaneglycol adipate | 600 | | | | | | | | | 1.0 |
| | 1,4-butaneglycol adipate | 1000 | | | | | | | | | |
| | 1,4-butaneglycol adipate | 2000 | | | | | | | | | |
| | polytetramethylene glycol | 650 | | | | | | | | | |
| | polytetramethylene glycol | 850 | | | | | | | | | |
| | polytetramethylene glycol | 1000 | | | | | | | | | |
| | polyethylene glycol | 600 | | | | 1.0 | | | | | |

TABLE 1-continued

| | | | | | | | | | | | | | |
|---|---|---|---|---|---|---|---|---|---|---|---|---|---|
| | bisphenol-A + propylene oxide | 800 | | | | | | | | | | | |
| Chain extender | ethylene glycol | 62 | | | | | | | | | | | |
| | 1,4-butane glycol | 90 | | | | | | | | | | | |
| | bis(2-hydroxyethyl)hydroquinone | 198 | | | 0.51 | | | | | | | | |
| | bisphenol-A + ethylene oxide | 327 | | 0.51 | | | 0.21 | 0.81 | 0.36 | 0.36 | | 0.36 | |
| | bisphenol-A + ethylene oxide | 360 | | | | | | | | | | | |
| | bisphenol-A + propylene oxide | 360 | 0.51 | | | | | | | | | | |
| Measured values of physical properties | Tg (°C.) | | 12 | 16 | −7 | −6 | −4 | 25 | 5 | −22 | | 10 | |
| | Crystallinity (wt %) | | | | 20 | 30 | | 20 | 25 | | | | |

| Raw materials and molar ratio | | M.W. | 19 | 20 | 21 | 22 | 23 | 24 | 25 | 26 |
|---|---|---|---|---|---|---|---|---|---|---|
| Diisocyanate | 2,4-toluene diisocyanate | 174 | | | | | | | | |
| | 4,4'-diphenylmethane diisocyanate | 250 | 1.35 | 1.35 | 1.35 | 1.35 | 1.35 | 1.5 | 1.5 | 1.35 |
| | 4,4'-diphenylmethane diisocyanate (carbodiimide-modified) | 290 | | | | | | | | |
| | 4,4'-diphenylmethane diisocyanate (carbodiimide-modified) | 303 | | | | | | | | |
| | hexamethylene diisocyanate | 168 | | | | | | | | |
| Polyol | polypropylene glycol | 400 | | | | | | | | 1.0 |
| | polypropylene glycol | 700 | | | | | | 1.0 | 1.0 | |
| | polypropylene glycol | 1000 | | | | | | | | |
| | 1,4-butaneglycol adipate | 600 | | | | | | | | |
| | 1,4-butaneglycol adipate | 1000 | 1.0 | | | | | | | |
| | 1,4-butaneglycol adipate | 2000 | | 1.0 | | | | | | |
| | polytetramethylene glycol | 650 | | | 1.0 | | | | | |
| | polytetramethylene glycol | 850 | | | | 1.0 | | | | |
| | polytetramethylene glycol | 1000 | | | | | 1.0 | | | |
| | polyethylene glycol | 600 | | | | | | | | |
| | bisphenol-A + propylene oxide | 800 | | | | | | | | |
| Chain extender | ethylene glycol | 62 | | | | | | | | |
| | 1,4-butane glycol | 90 | | | | | | | | |
| | bis(2-hydroxyethyl)hydroquinone | 198 | | | | | | | | |
| | bisphenol-A + ethylene oxide | 327 | 0.36 | 0.36 | 0.36 | 0.36 | 0.36 | 0.43 | 0.35 | 0.36 |
| | bisphenol-A + ethylene oxide | 360 | | | | | | | | |
| | bisphenol-A + propylene oxide | 360 | | | | | | | | |
| Measured values of physical properties | Tg (°C.) | | −18 | −45 | −18 | −30 | −38 | 5 | 8 | 23 |
| | Crystallinity (wt %) | | 25 | 25 | 25 | 25 | | 25 | 15 | 15 |

| Raw materials and molar ratio | | M.W. | 27 | 28 | 29 | 30 | 31 | 32 | 33 | 34 | 35 | 36 | 37 |
|---|---|---|---|---|---|---|---|---|---|---|---|---|---|
| Diisocyanate | 2,4-toluene diisocyanate | 174 | 1.5 | 1.4 | 1.3 | 1.2 | | | 1.5 | | | | |
| | 4,4'-diphenylmethane diisocyanate | 250 | | | | | 1.59 | 1.68 | | 1.3 | 1.7 | 1.59 | 1.68 |
| | 4,4'-diphenylmethane diisocyanate (carbodiimide-modified) | 290 | | | | | | | | | | | |
| | 4,4'-diphenylmethane diisocyanate (carbodiimide-modified) | 303 | | | | | | | | | | | |
| | hexamethylene diisocyanate | 168 | | | | | | | | | | | |
| Polyol | polypropylene glycol | 400 | | | | | | | | | | | |
| | polypropylene glycol | 700 | | | | | 1.0 | 1.0 | | 1.0 | 1.0 | 1.0 | 1.0 |
| | polypropylene glycol | 1000 | | | | | | | | | | | |
| | 1,4-butaneglycol adipate | 600 | | | | | | | | | | | |
| | 1,4-butaneglycol adipate | 1000 | | | | | | | | | | | |
| | 1,4-butaneglycol adipate | 2000 | | | | | | | | | | | |
| | polytetramethylene glycol | 650 | | | | | | | | | | | |
| | polytetramethylene glycol | 850 | | | | | | | | | | | |
| | polytetramethylene glycol | 1000 | | | | | | | | | | | |
| | polyethylene glycol | 600 | | | | | | | | | | | |
| | bisphenol-A + propylene oxide | 800 | 1.0 | 1.0 | 1.0 | 1.0 | | | 1.0 | | | | |
| Chain extender | ethylene glycol | 62 | | | | | | | | 0.31 | 0.71 | 0.51 | 0.51 |
| | 1,4-butane glycol | 90 | | | | | | | | | | | |
| | bis(2-hydroxyethyl)hydroquinone | 198 | 0.51 | 0.41 | 0.31 | 0.21 | | | 0.51 | | | | |
| | bisphenol-A + ethylene oxide | 327 | | | | | | | | | | | |
| | bisphenol-A + ethylene oxide | 360 | | | | | 0.51 | 0.51 | | | | | |
| | bisphenol-A + propylene oxide | 360 | | | | | | | | | | | |
| Measured values of physical properties | Tg (°C.) | | 26 | 21 | 19 | 19 | 10 | 11 | 22 | 2 | 15 | 11 | 12 |
| | Crystallinity (wt %) | | 10 | 15 | 15 | 15 | 15 | 20 | 15 | 20 | 15 | 15 | 10 |

| Raw materials and molar ratio | | M.W. | 38 | 39 | 40 |
|---|---|---|---|---|---|
| Diisocyanate | 2,4-toluene diisocyanate | 174 | | | |
| | 4,4'-diphenylmethane diisocyanate | 250 | 1.5 | 1.5 | 1.81 |
| | 4,4'-diphenylmethane diisocyanate (carbodiimide-modified) | 290 | | | |
| | 4,4'-diphenylmethane diisocyanate (carbodiimide-modified) | 303 | | | |
| | hexamethylene diisocyanate | 168 | | | |
| Polyol | polypropylene glycol | 400 | | | |
| | polypropylene glycol | 700 | | | |
| | polypropylene glycol | 1000 | | | |
| | 1,4-butaneglycol adipate | 600 | | | |
| | 1,4-butaneglycol adipate | 1000 | | | |
| | 1,4-butaneglycol adipate | 2000 | | | |
| | polytetramethylene glycol | 650 | | | |
| | polytetramethylene glycol | 850 | | | |

TABLE 1-continued

| | | | | | |
|---|---|---|---|---|---|
| | polytetramethylene glycol | 1000 | | | |
| | polyethylene glycol | 600 | | | |
| | bisphenol-A + propylene oxide | 800 | 1.0 | 1.0 | 1.0 |
| Chain extender | ethylene glycol | 62 | | | |
| | 1,4-butane glycol | 90 | 0.51 | | |
| | bis(2-hydroxyethyl)hydroquinone | 198 | | 0.51 | 0.81 |
| | bisphenol-A + ethylene oxide | 327 | | | |
| | bisphenol-A + ethylene oxide | 360 | | | |
| | bisphenol-A + propylene oxide | 360 | | | |
| Measured values of physical properties | Tg (°C.) | | 35 | 40 | 48 |
| | Crystallinity (wt %) | | 10 | 5 | 5 |

[2] Weaving of shape memory polyurethane

Example (1) A cloth was woven only from yarns spun from the shape memory polyurethane, sample No. 2 in Table 1. The Tg of this cloth was −10° C.

Example (2) A cloth was woven from the yarns of the shape memory polyurethane in Example (1) as warps and ordinary cotton yarns as wefts. The Tg of this cloth was −10° C.

Example (3) A cloth was woven from a 50:50 blended yarns of fibers of the shape memory polyurethane, sample No. 2 in Table 1, and ordinary cotton fibers. The Tg of this cloth was −10° C.

Example (4) A cloth was woven only from the yarns spun from the shape memory polyurethane, sample No. 39 in Table 1. The Tg of this cloth was 40° C.

Example (5) A cloth was woven from the yarns of the shape memory polyurethane in Example (4) as warps and ordinary cotton yarns as wefts. The Tg of this cloth was 40° C.

Example (5) A cloth was woven from a 50:50 blended yarns of fibers of the shape memory polyurethane, sample No. 39 in Table 1, and ordinary cotton fibers. The Tg of this cloth was 40° C.

[3] Use of the shape memory woven cloth

Example (A) Each of the cloths prepared in Examples (1) to (3) was folded over and heated in a trouser press at a temperature at which the polyurethane, sample No. 2, begins to flow. After being kept at this temperature for 5 minutes, the cloth was cooled to normal temperature, so that the crease was set (or the cloth was caused to remember the crease).

These cloths gave exactly the same hand as the cloths of ordinary natural or synthetic fibers.

When they were washed for 1 hour using a washing machine and then dried, they did not wrinkle.

Example (B) Each of the cloths prepared in Examples (4) to (6) was heated in a shoulder pad press at a temperature at which the polyurethane, sample No. 39, begins to flow. After being kept at this temperature for 5 minutes, the cloth was cooled to normal temperature, so that the shape of shoulder pad was set (or the cloth was caused to remember the shape of shoulder pad).

These cloths gave hard hand at normal temperature, but they are not so hard as plastic plate. They gave the hand of cloth and did not give unpleasant feeling when kept in contact with the human skin for a long time.

The cloths in the shape of shoulder pad were washed in a washing machine for 1 hour and then dried. They slightly wrinkled and deformed; but they restored their original shape when heated with a hair drier at a temperature higher than the Tg. They retained their shape even when they were cooled below the Tg.

Incidentally, when the wrinkled and deformed cloths were heated by bringing them into contact with the human arm instead of using a hair drier, they restored their original shape in 20 seconds to 1 minute.

Example (C) Each of the cloths prepared in Examples (4) to (6) was softened at 50° C. (higher than the Tg) and folded over and pressed between two flat plates under a pressure of 0.5-2.0 kgf/mm$^2$, Then, it was cooled to a temperature lower than the Tg in the folded state so that the folded state was set.

These cloths gave hard hand at normal temperature as in Example (B), but they are not so hard as plastic plate. They gave the hand of cloth and did not give unpleasant feeling when kept in contact with the human skin for a long time.

The cloths in the folded shape were washed in a washing machine for 1 hour and then dried. They slightly wrinkled and deformed as in Example (B); but they restored their original shape when heated with a hair drier at a temperature higher than the Tg. They retained their shape even when they were cooled below the Tg.

Incidentally, when the wrinkled and deformed cloths were heated by bringing them into contact with the human arm instead of using a hair drier, they restored their original shape in 20 seconds to 1 minute.

As mentioned in detail above, the woven cloth of the present invention offers the following advantages inherent in woven cloth.

(1) The thickness of the woven fabric can be easily controlled by properly selecting the fineness of yarns.

(2) The woven fabric does not need any adhesive. Therefore, unlike the conventional nonwoven fabric which absolutely needs an adhesive, the woven fabric has no fear of becoming uneven in thickness and strength due to the uneven distribution of adhesive.

(3) The woven fabric is low in production cost because it needs no adhesive.

(4) The woven fabric can be woven from a blend composed of the fibers (or yarns) of the shape memory polymer and ordinary natural or synthetic fibers (or yarns thereof). The blend may be in the form of blended yarn or different yarns.

(5) The woven fabric can be produced at a low production cost for the reasons given in (3) and (4) above.

(6) Owing to its shape memory performance, the woven fabric can be used in various ways depending on the Tg of the shape memory polymer used in the woven fabric or the way in which the woven fabric was caused to remember the shape. It can be used in various application areas and in various places ranging from cold districts to hot districts.

We claim:

1. A woven fabric of shape memory polymer which is formed by weaving yarns of shape memory polymer fibers alone or by weaving said yarns and yarns or ordinary natural or synthetic fibers wherein the shaped memory polymer fibers are made of a polyurethane elastomer having a shaped memory property wherein the elastomer undergoes changes in an elastic modulus around a glass transition point high than about 40° C., the elastomer becoming rubbery at temperatures higher than the glass transition product, and becoming glassy at a temperature lower than the glass transition point, and with which property a deformed shape can be set in the woven fabric by cooling the woven fabric as deformed to a temperature lower than the glass transition point after making the elastomer memorize a basic shape, the basic shape being recovered by heating the woven fabric to a temperature higher than the glass transition point.

2. A woven fabric of shape memory polymer which is formed by weaving blended yarns of shape memory polymer fibers and ordinary natural or synthetic fibers wherein said shape memory polymer fibers are made of a polyurethane elastomer having a shape memory property wherein the elastomer undergoes changes in an elastic modulus around a glass transition point higher than about 40° C., the elastomer becoming rubbery at temperatures higher than the glass transition point and becoming glassy at a temperature lower than the glass transition point, and with which property a deformed shaped can be set in the woven fabric by cooling the woven fabric as deformed to a temperature lower than the glass transition point after making the elastomer memorize a basic shape, the basic shape being recovered by heating the woven fabric to a temperature higher than the glass transition point.

3. A woven fabric as claimed in claim 1, wherein the yarns of the shape memory polymer fibers and the yarns of natural or synthetic fibers are blended in the ratio of 10-95/90-5 wt %.

4. A woven fabric as claimed in claim 2, wherein the blended yarns are composed of the shape memory polymer fibers and natural or synthetic fibers in the ratio of 10-95/90-5 wt %.

5. A woven fabric of shape memory polymer which is formed by weaving yarns of shape memory polymer fibers alone or by weaving said yarns and yarns of ordinary natural or synthetic fibers wherein the yarns or fibers of the shape memory polymer have a glass transition point lower than normal temperature and the shape of the fabric is set at a temperature higher than normal temperature.

6. A woven fabric of shape memory polymer which is formed by weaving yarns of shape memory polymer fibers alone or by weaving said yarns and yarns of ordinary natural or synthetic fibers wherein the yarns or fibers of the shape memory polymer have a glass transition point lower than normal temperature and the shape of the fabric is set at a temperature approximate to the temperature at which said polymer begins to flow.

7. A woven fabric of shape memory polymer which is formed by weaving yarns of shape memory polymer fibers alone or by weaving said yarns and yarns of ordinary natural or synthetic fibers wherein the yarns or fibers of the shape memory polymer have a glass transition point higher than normal temperature and the shape of the fabric is set at a temperature approximate to the temperature at which said polymer begins to flow.

8. A woven fabric of shape memory polymer which is formed by weaving blended yarns of shape memory polymer fibers and ordinary natural or synthetic fibers wherein the yarns or fibers of the shape memory polymer have a glass transition. point lower than normal temperature and the shape of the fabric is set at a temperature higher than normal temperature.

9. A woven fabric of shape memory polymer which is formed by weaving blended yarns of shape memory polymer fibers and ordinary natural or synthetic fibers wherein the yarns or fibers of the shape memory polymer have a glass transition point lower than normal temperature and the shape of the fabric is set at a temperature approximate to the temperature at which said polymer begins to flow.

10. A woven fabric of shape memory polymer which is formed by weaving blended yarns of shape memory polymer fibers and ordinary natural or synthetic fibers wherein the yarns or fibers of the shape memory polymer have a glass transition point higher than normal temperature and the shape of the fabric is set at a temperature approximate to the temperature at which said polymer begins to flow.

* * * * *